US010801150B2

(12) United States Patent
Kang et al.

(10) Patent No.: US 10,801,150 B2
(45) Date of Patent: Oct. 13, 2020

(54) WASHING MACHINE CAPABLE OF CONTROLLING CONTROL PANEL RELATED TO OPERATION OF HEATERS

(71) Applicant: Samsung Electronics Co., Ltd., Suwon-si, Gyeonggi-do (KR)

(72) Inventors: Min-Ji Kang, Yongin-si (KR); Kyoung Tae Park, Suwon-si (KR); Hyun Sook Kim, Hwaseong-si (KR); Hyeon Cheol Kim, Seoul (KR); Jung Ran Jung, Suwon-si (KR); Eun-Young Park, Suwon-si (KR); Dong-Il Back, Hwaseong-si (KR); Jun-Young Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 133 days.

(21) Appl. No.: 15/854,323

(22) Filed: Dec. 26, 2017

(65) Prior Publication Data

US 2018/0179689 A1 Jun. 28, 2018

(30) Foreign Application Priority Data

Dec. 23, 2016 (KR) ..... 10-2016-0178527

(51) Int. Cl.
*D06F 29/00* (2006.01)
*D06F 39/04* (2006.01)
(Continued)

(52) U.S. Cl.
CPC ..... *D06F 34/22* (2020.02); *D06F 34/28* (2020.02); *D06F 39/045* (2013.01);
(Continued)

(58) Field of Classification Search
CPC ..... D06F 33/02; D06F 2204/04; D06F 31/00; D06F 39/005; D06F 29/00;
(Continued)

(56) References Cited

U.S. PATENT DOCUMENTS

2008/0022465 A1 1/2008 Jun et al.
2010/0146712 A1* 6/2010 Finch ..... G06Q 50/06 8/137
(Continued)

FOREIGN PATENT DOCUMENTS

CN 101113557 A 1/2008
CN 101876137 A 11/2010
(Continued)

OTHER PUBLICATIONS

European Office Action dated Feb. 6, 2020, issued in a counterpart European application No. 17 199 145.8-1016.
(Continued)

*Primary Examiner* — Joseph L. Perrin
*Assistant Examiner* — Irina Graf
(74) *Attorney, Agent, or Firm* — Jefferson IP Law, LLP

(57) ABSTRACT

A washing machine and a method for controlling the same are disclosed. The washing machine includes a plurality of washing devices, each of which includes a heater. Based on a target temperature of wash water heated by one heater of any one of the washing devices, the washing machine changes a target temperature setting environment of wash water heated by the remaining heater. The washing machine includes a first heater to heat wash water stored in a first tub, a second heater to heat wash water stored in a second tub, a control panel to provide a target temperature setting menu for setting a target temperature of the wash water stored in the first tub, and a controller to drive the first heater and the second heater. The controller changes the target temperature
(Continued)

setting menu supplied from the control panel in response to the second target temperature.

8 Claims, 15 Drawing Sheets

(51) Int. Cl.

| | |
|---|---|
| ***D06F 33/46*** | (2020.01) |
| ***D06F 34/22*** | (2020.01) |
| ***D06F 34/28*** | (2020.01) |
| ***D06F 39/08*** | (2006.01) |
| *D06F 31/00* | (2006.01) |

(52) U.S. Cl.
CPC ..... *D06F 39/088* (2013.01); *D06F 29/00* (2013.01); *D06F 31/00* (2013.01); *D06F 2202/04* (2013.01); *D06F 2204/04* (2013.01)

(58) Field of Classification Search
CPC ..... D06F 2202/04; D06F 2216/00; D06F 29/005; D06F 2202/12; D06F 2212/02; D06F 2220/00; D06F 2058/2883
See application file for complete search history.

(56) References Cited

U.S. PATENT DOCUMENTS

| | | | | |
|---|---|---|---|---|
| 2011/0041258 | A1* | 2/2011 | Ko | D06F 29/00 8/137 |
| 2011/0061175 | A1 | 3/2011 | Kappler | |
| 2016/0201248 | A1* | 7/2016 | Kim | D06F 39/087 8/137 |
| 2017/0342626 | A1* | 11/2017 | Li | D06F 31/00 |
| 2018/0057987 | A1* | 3/2018 | Li | D06F 31/00 |

FOREIGN PATENT DOCUMENTS

| | | | | | |
|---|---|---|---|---|---|
| CN | 102203337 | A | | 9/2011 | |
| CN | 104790168 | A | | 7/2015 | |
| CN | 105734915 | A | | 7/2016 | |
| EP | 1 882 768 | A2 | | 1/2008 | |
| EP | 2 065 504 | A1 | | 6/2009 | |
| KR | 10-2008-0022786 | A | | 3/2008 | |
| KR | 10-2009-0017804 | A | | 2/2009 | |
| KR | 10-2009-0054786 | A | | 6/2009 | |
| KR | 10-2009-0054788 | A | | 6/2009 | |
| KR | 20150028180 | A | * | 3/2015 | D06F 39/02 |
| WO | WO-2016090969 | A1 | * | 6/2016 | D06F 31/00 |
| WO | WO-2016141714 | A1 | * | 9/2016 | D06F 31/00 |

OTHER PUBLICATIONS

Chinese Office Action dated Oct. 9, 2019, issued in a counterpart Chinese application No. 201711402754.X.

* cited by examiner

WASHING MACHINE CAPABLE OF CONTROLLING CONTROL PANEL RELATED TO OPERATION OF HEATERS

CROSS-REFERENCE TO RELATED APPLICATION

This application claims the benefit of Korean Patent Application No. 10-2016-0178527, filed on Dec. 23, 2016 in the Korean Intellectual Property Office, the disclosure of which is incorporated herein by reference.

BACKGROUND

1. Field

Embodiments of the present disclosure relate to a washing machine including a plurality of washing devices, and a method for controlling the same.

2. Description of the Related Art

Generally, a washing machine is an apparatus that washes laundry by rotating a cylindrical rotary tub containing the laundry. Washing machines are classified into a horizontal-axis washing machine and a vertical-axis washing machine. The horizontal-axis washing machine is provided with a horizontally-arranged drum, such that laundry is washed by being lifted along an inner circumferential surface of the drum and falling when the drum rotates about a horizontal axis thereof. The vertical-axis washing machine is provided with a drum including a pulsator and vertically arranged, such that laundry is washed using a water current produced by the pulsator when the drum rotates about a vertical axis thereof.

The horizontal-axis washing machine including a horizontally arranged drum allows laundry to be introduced into the drum through an opening provided at the front thereof, so that the drum washing machine is referred to as a front loading washing machine. The vertical-axis washing machine including a vertically arranged drum allows laundry to be introduced into the drum through an opening provided at the top thereof, so that vertical-axis washing machine is referred to as a top loading washing machine.

A general washing machine is implemented as one of the above-mentioned two types of washing machines, and washes laundry. In order to use advantages of both types of washing machine, a washing machine including a plurality of washing devices driven in different ways has recently been developed.

SUMMARY

Therefore, it is an aspect of the present disclosure to provide a washing machine including a plurality of washing devices each having a heater so that, based on a target temperature of wash water heated by a heater of any one of the washing devices, a target temperature setting environment of wash water heated by heaters of the remaining washing devices is changed, and a method for controlling the same.

Additional aspects of the invention will be set forth in part in the description which follows and, in part, will be obvious from the description, or may be learned by practice of the invention.

In accordance with one aspect of the present disclosure, a washing machine includes: a first heater configured to heat wash water stored in a first tub; a second heater configured to heat wash water stored in a second tub; a control panel configured to provide a target temperature setting menu for setting a target temperature of the wash water stored in the first tub; and a controller configured to drive the first heater in a manner that the wash water stored in the first tub reaches a first target temperature, and drive the second heater in a manner that the wash water stored in the second tub reaches a second target temperature, wherein the controller changes the target temperature setting menu supplied from the control panel in response to the second target temperature.

The first tub may include a first laundry inlet disposed at a front part thereof, and the second tub may include a second laundry inlet disposed at an upper part thereof.

When the second target temperature is equal to or higher than a predetermined second threshold temperature, the controller may limit the target temperature setting menu to prevent the first target temperature from being set to a temperature equal to or higher than a first threshold temperature.

The controller may control driving of the first heater and the second heater in a manner that the wash water stored in the first tub reaches the first target temperature before the wash water stored in the second tub reaches the second target temperature.

The control panel may provide a washing mode selection menu through which any one of a plurality of washing modes for washing laundry stored in the second tub according to different conditions is selected. The plurality of washing modes may include one mode in which the wash water stored in the second tub needs to be heated and another mode in which the wash water stored in the second tub need not be heated.

The controller may limit the washing mode selection menu such that the one mode in which the wash water needs to be heated is prevented from being selected.

In accordance with another aspect of the present disclosure, a washing machine includes: a first washing device configured to include a first tub storing wash water therein and a first heater heating the wash water stored in the first tub; a second washing device configured to include a second tub storing wash water therein and a second heater heating the wash water stored in the second tub; and a control panel configured to provide a first washing mode selection menu through which any one of a plurality of first washing modes for washing laundry stored in the first tub according to different conditions is selected, and provide a second washing mode selection menu through which any one of a plurality of second washing modes for washing laundry stored in the second tub according to different conditions is selected. The first washing mode includes at least one mode in which the wash water stored in the first tub needs to be heated and at least one mode in which the wash water stored in the first tub need not be heated. The second washing mode includes at least one mode in which the wash water stored in the second tub needs to be heated and at least one mode in which the wash water stored in the second tub need not be heated. When the first washing device operates in the mode in which the wash water stored in the first tub needs to be heated, the control panel limits the second washing mode selection menu in a manner that the mode in which the wash water stored in the second tub needs to be heated is prevented from being selected.

The first washing device may include a first laundry inlet disposed at a front part thereof. The second washing device may include a second laundry inlet disposed at an upper part thereof.

When the second washing device operates in a mode in which the wash water stored in the second tub needs to be heated to a second threshold temperature or higher from among the modes in which the wash water stored in the second tub needs to be heated, the control panel may limit the first washing mode selection menu in a manner that the mode in which the wash water stored in the first tub needs to be heated is prevented from being selected.

When operating in the mode in which the wash water stored in the first tub needs to be heated, the first washing device may drive the first heater in a manner that the wash water stored in the first tub reaches a first target temperature.

When operating in the mode in which the wash water stored in the second tub needs to be heated, the second washing device may drive the second heater in a manner that the wash water stored in the second tub reaches a second target temperature.

The first washing device may drive the first heater in a manner that the wash water stored in the first tub reaches the first target temperature before the wash water stored in the second tub reaches the second target temperature.

In accordance with another aspect of the present disclosure, a method for controlling a washing machine that includes a first heater configured to heat wash water stored in a first tub, a second heater configured to heat wash water stored in a second tub, and a control panel configured to provide a target temperature setting menu for setting a target temperature of the wash water stored in the first tub, includes: confirming a second target temperature of the wash water stored in the second tub; and limiting the target temperature setting menu according to the second target temperature, such that a first target temperature of the wash water stored in the first tub is prevented from being set to a temperature equal to or higher than a first threshold temperature.

The method may further include: driving the second heater, upon confirming that the wash water stored in the first tub reaches the first target temperature.

The method may further include: upon confirming that the second heater is in operation, stopping driving of the second heater, and driving the first heater; and upon confirming that the wash water stored in the first tub reaches the first target temperature, driving the second heater.

The control panel may provide a washing mode selection menu through which any one of a plurality of washing modes for washing laundry stored in the second tub according to different conditions is selected. The plurality of washing modes may include a mode in which the wash water stored in the second tub needs to be heated and a mode in which the wash water stored in the second tub need not be heated. The method may further include: limiting the washing mode selection menu according to the first target temperature, such that the mode in which the wash water stored in the second tub needs to be heated is prevented from being selected.

The limiting the target temperature setting menu may include, when the second target temperature is equal to or higher than a predetermined second threshold temperature, limiting the target temperature setting menu such that the first target temperature of the wash water stored in the first tub is prevented from being set to a temperature equal to or higher than a first threshold temperature.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
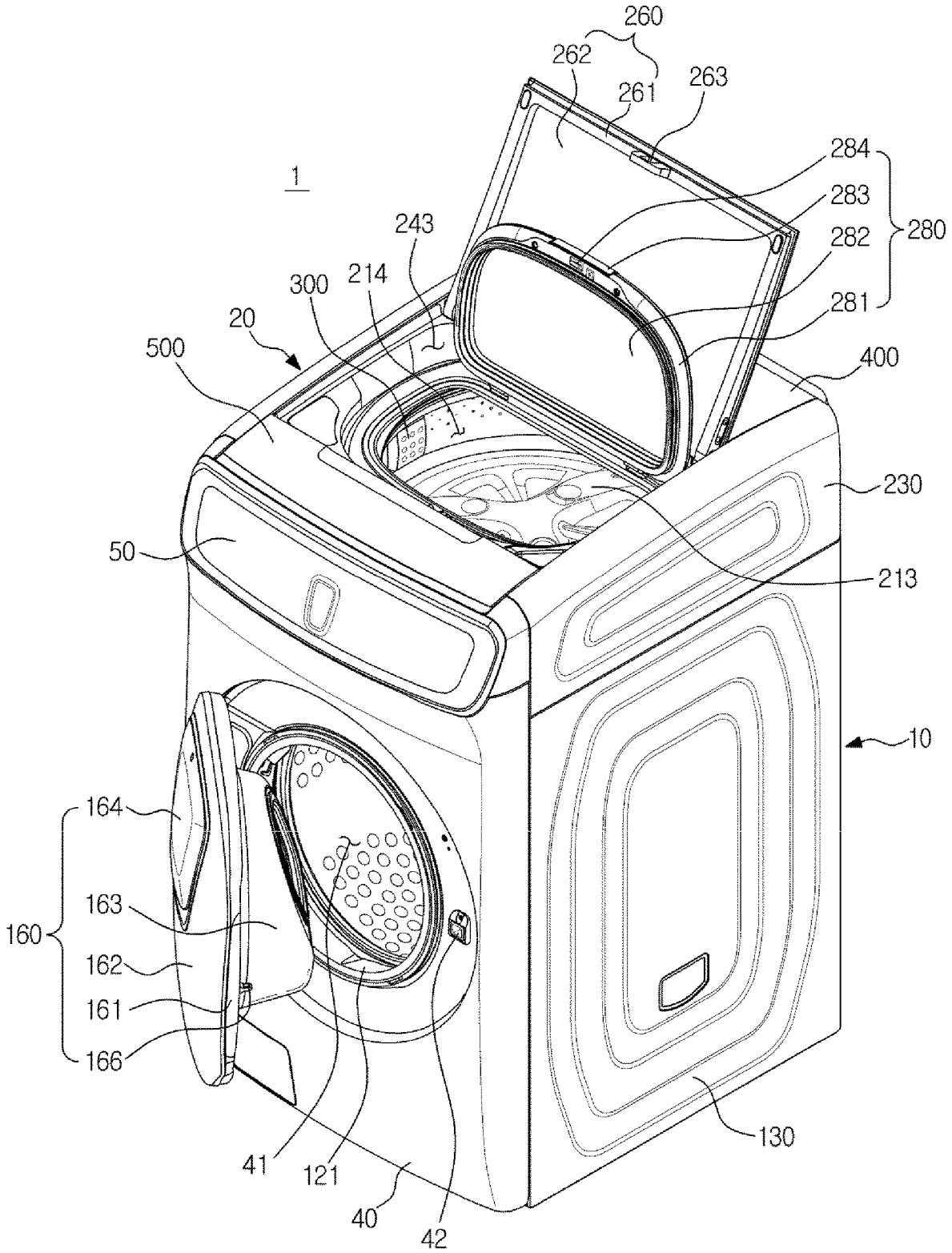
FIG. 1 is a perspective view illustrating a washing machine according to an embodiment of the present disclosure.

Reference will now be made in detail to the embodiments of the present disclosure, examples of which are illustrated in the accompanying drawings, wherein like reference numerals refer to like elements throughout.

The terms used in the present application are merely used to describe specific embodiments and are not intended to limit the present disclosure. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component. For example, a first component may be called a second component and a second component may be called a first component without departing from the scope of the present disclosure. The term "and/or" may include a combination of a plurality of items or any one of a plurality of items.

Figure 2:
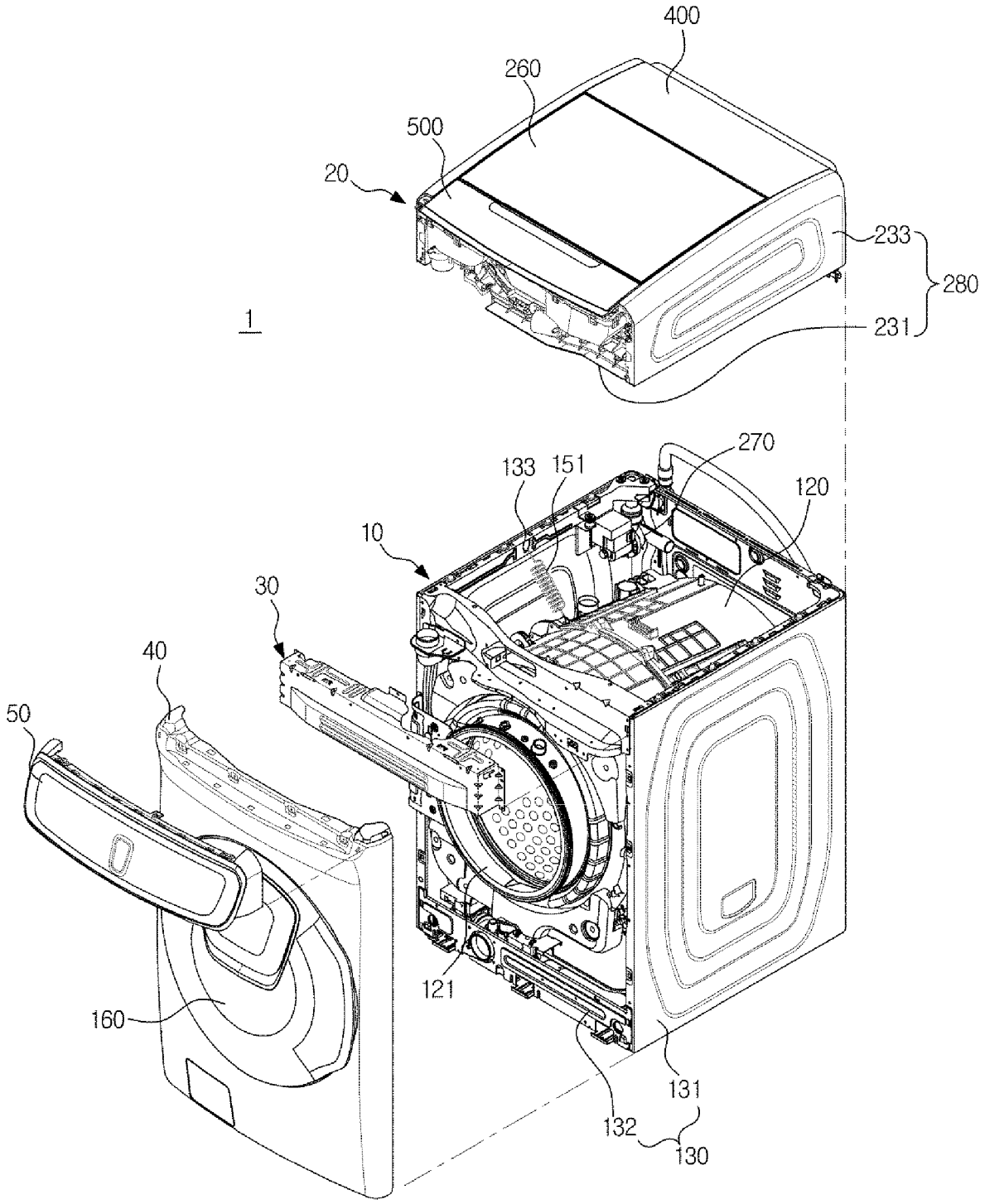
FIG. 2 is an exploded perspective view illustrating a first washing device and a second washing device included in the washing machine of FIG. 1 according to an embodiment of the present disclosure.
Figure 3:
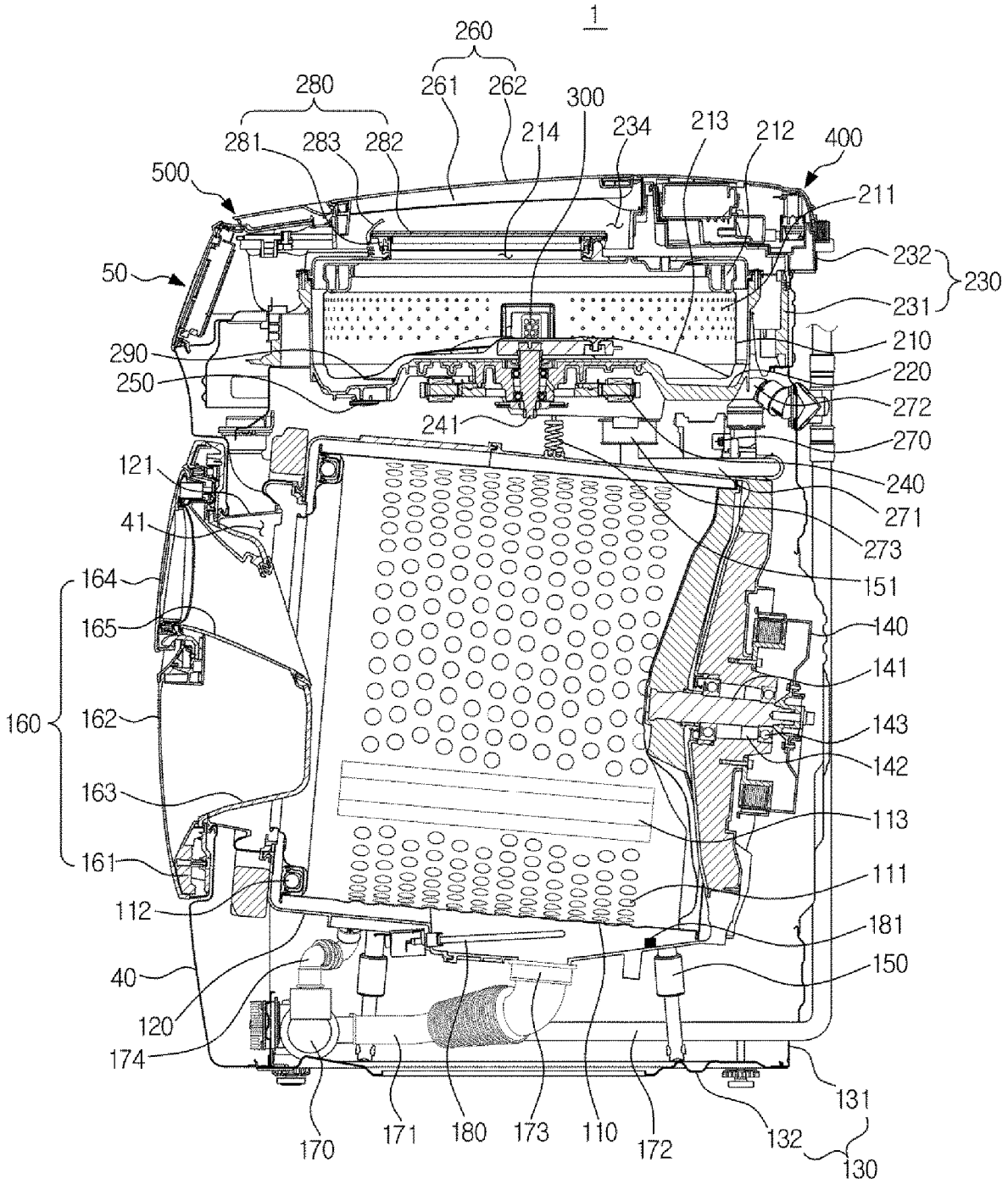
FIG. 3 is a cross-sectional view illustrating the washing machine shown in FIG. 1.
Figure 4A:
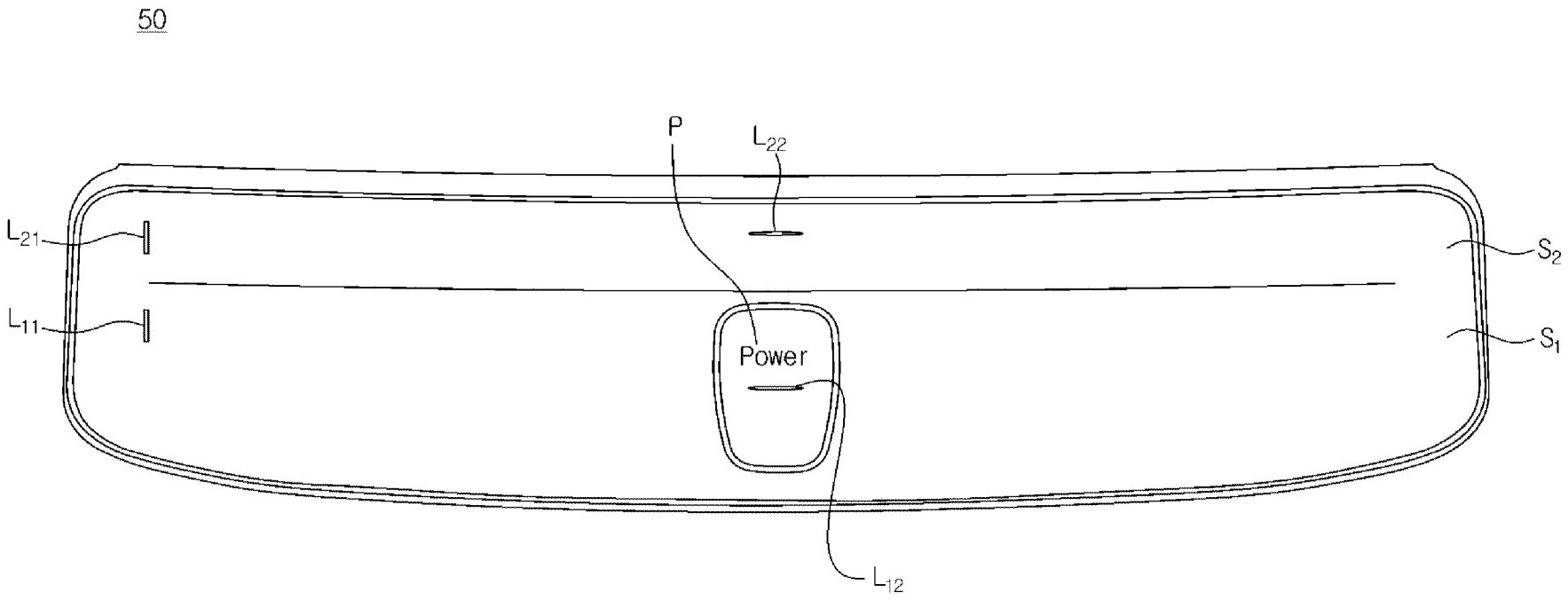
FIGS. 4A and 4B are views illustrating change in a control panel when the washing machine is powered on or off according to an embodiment of the present disclosure.
Figure 4B:
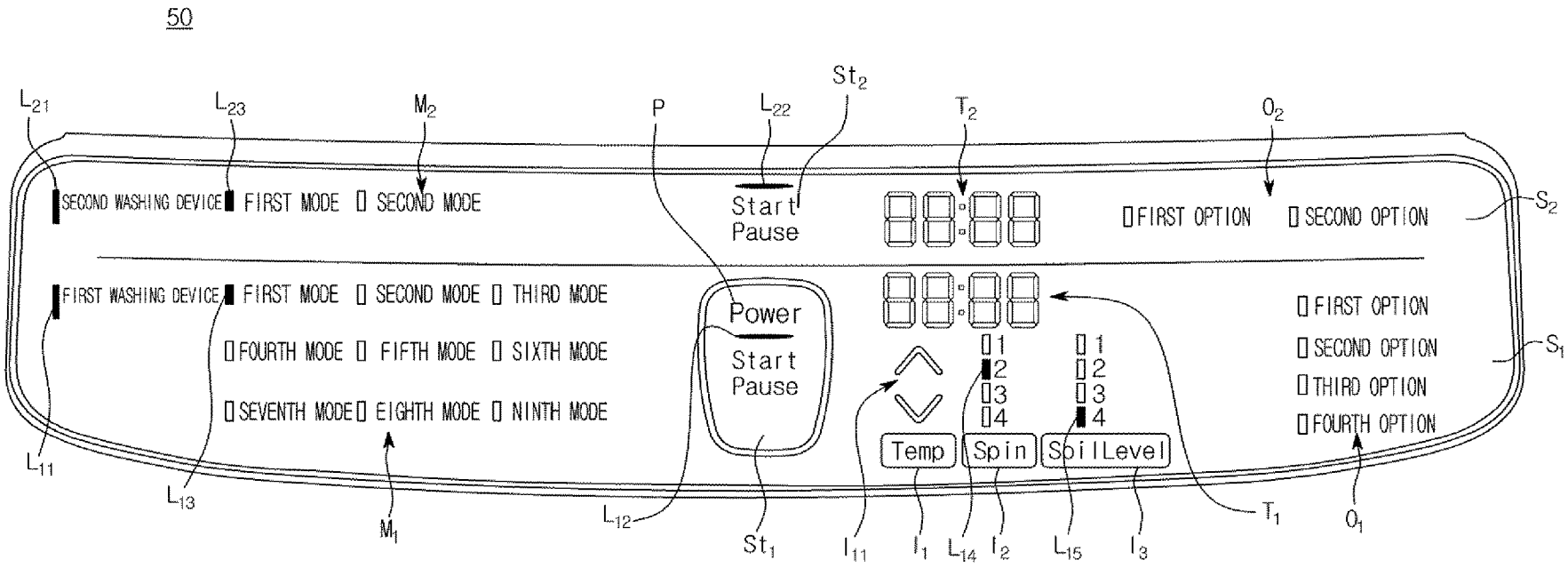

FIG. 1 is a perspective view illustrating a washing machine according to an embodiment of the present disclosure. FIG. 2 is an exploded perspective view illustrating a first washing device and a second washing device included in the washing machine of FIG. 1 according to an embodiment of the present disclosure. FIG. 3 is a cross-sectional view illustrating the washing machine shown in FIG. 1. FIGS. 4A and 4B are views illustrating change in a control panel when the washing machine is powered on or off according to an embodiment of the present disclosure.

Referring to FIGS. 1 to 3, the washing machine 1 may include a first washing device 10 implemented as a front loading washing machine configured to allow laundry to be introduced into a drum through an opening (i.e., a laundry inlet) provided at the front thereof, and a second washing device 20 implemented as a top loading washing machine configured to allow laundry to be introduced into a drum through a laundry inlet provided at the top thereof. The second washing device 20 may be provided on the first washing device 10.

The first washing device 10 may include a first drum 110 having a first washing space therein, and a first tub 120 having the first drum 110 to store either wash water to be used in a washing process or rinse water to be used in a rinsing process. Each of the first drum 110 and the first tub 120 may be formed in a cylindrical shape, at least a part of one surface of which is opened. The open surface is arranged to face forward.

The first washing device 10 may include a first housing 130. The first housing 130 may include a side frame 131 forming external appearance of a side surface and a rear surface of the first washing device 10, and a bottom frame 132 forming a bottom surface of the first washing device 10.

The first washing device 10 may include a spring 151 and a damper 150 to allow the first tub 120 to be supported by the first housing 130. The damper 130 may connect an outer surface of the first tub 120 to the bottom frame 132 such that the first tub 120 is supported at a lower portion of the first washing device 10. The spring 151 may connect an outer surface of the first tub 120 to a spring coupling portion 133 provided at an upper portion of the side frame 131 such that the first tub 120 is supported at an upper portion of the first washing device 10. The spring 151 and the damper 150 may mitigate vibration, noise, and impact encountered by movement of the first tub 120.

Installation positions of the spring 151 and the damper 150 are not limited to the upper end of the side frame 131 and the bottom frame 132. If necessary, the spring 151 and the damper 150 may support the first tub 120 by connecting one surface of the first tub 120 to some parts of the first housing 130.

The first washing device 10 may include a first drive motor 140 that is disposed at a rear of the first tub 120 and rotates the first drum 110. A first drive shaft 141 for carrying power of the first drive motor may be connected to a rear surface of the first drum 110. A plurality of first through-holes 111 through which wash water passes may be formed around the drum 30. A plurality of lifters 113 may be installed on an inner circumferential surface of the first drum 110 so that laundry may be lifted or fallen during rotation of the first drum 110. A first balancer 112 may be mounted to a front portion of the first drum so that the first drum 110 stably rotates at a high speed.

The first drive shaft 141 may be disposed between the first drum 110 and the first drive motor 140. One end of the first drive shaft 141 may be connected to a rear plate of the first drum 110, and the other end of the first drive shaft 141 may extend to outside of a rear wall of the first tub 120. When the first drive motor 140 drives the first drive shaft 141, the first drum 110 connected to the first drive shaft 141 may rotate around the first drive shaft 141.

The rear wall of the first tub 120 is provided with a bearing housing 142 to rotatably support the first drive shaft 11. The bearing housing 142 may be formed of aluminum alloy, and be inserted into the rear wall of the first tub 120 during injection molding of the first tub 20. Bearings 143 may be installed between the bearing housing 142 and the first drive shaft 141 so that the first drive shaft 141 may be smoothly rotated.

The first washing device 10 may include a function of washing laundry with hot water. In order to obtain hot water, the first tub 120 may be provided with a first heater 180 installed at the bottom surface thereof so as to heat wash water or rinse water stored in the first tub 120. The first washing device 10 may further include a temperature sensor 181 configured to detect a temperature of wash water or rinse water stored in the first tub 120.

The first washing device 10 may include a first drain pump 170, a first connection hose 171, a circulation hose 174, and a first drain hose 172. The first drain pump 170 is provided at a lower portion of the first tub 120 to discharge water in the first tub 120 to the outside of the washing machine 1. The connection hose 171 connects the first drain hole 173 of the first tub 120 to the first drain pump 170 such that water in the first tub 120 is introduced into the first drain pump 170. The circulation hose 174 connects the first drain pump 170 to the first tub 129 such that water introduced into the first drain pump 170 may circulate in the first tub 120. The first drain hose 172 may guide water pumped by the first drain pump 170 to the outside of the washing machine 1.

The washing machine 1 may include a front cover 40 having a first inlet 41 through which laundry is introduced into a first washing space of the first washing device 10. The front cover 40 may be coupled to a first door 160 configured to open or close the first inlet 41.

The first door 160 may be provided to correspond to the first inlet 41, and may be configured to pivot with respect to the front cover 40. The first door 160 may include a first door frame 161, a first door cover 162, and a door glass 163.

Although the first door frame 161 of the above-mentioned embodiment is formed in a substantially ring shape for convenience of description and better understanding of the present disclosure, the first door frame 161 may also be formed in a substantially rectangular shape without departing from the scope or spirit of the present disclosure. The first door cover 161 and the door glass 163 may be formed of transparent material such that a user who is located outside the washing machine 1 may view an inner space of the first drum 110 even when the first door 160 closes the first inlet 41. The door glass 163 may be provided to convexly protrude from the first door frame 161 toward the interior of the first drum 110. Through the above structure, when the first door 160 is closed, the door glass 163 may be inserted into the first inlet 41.

A first hinge is provided in the vicinity of the first inlet 41 to allow the first door 160 to pivot with respect to the front cover 40, and is coupled to a first hinge coupling portion formed at one side of the first door frame 161. A first hook 166 may be provided at the other side of the first door frame 161, and the front cover 40 may include a first hook container 42 formed at a position corresponding to the first hook 166, such that the first door 160 closes the first inlet 41 and is kept locked.

In order to allow laundry to be introduced into the first washing space even when the first door 160 is closed, the first door 160 may include an auxiliary laundry inlet and an auxiliary door 164 for opening or closing the auxiliary laundry inlet. The auxiliary door 164 may be pivotably coupled to the first door cover 162.

In order to allow laundry to be introduced into the inside of the washing machine through the auxiliary laundry inlet of the first door 160, the laundry has to pass through the door glass 163. For this purpose, the door glass 163 may include a glass through-hole. Alternatively, an upper portion of the door glass 163 may be collapsed or dented such that the door glass is not provided at a rear of the auxiliary laundry inlet.

In order to connect the auxiliary laundry inlet of the first door 160 to the glass through-hole of the door glass 153, the first door 160 may include a connection guide portion 165. Both ends of the connection guide portion 165 may be opened, such that the connection guide portion 165 may be formed to have a hollow cylindrical pipe shape.

In detail, one end of the connection guide portion 165 may be connected to the auxiliary laundry inlet, and the other end of the connection guide portion 165 may be connected to the glass through-hole. In the above-mentioned embodiment, the connection guide portion 165 may be tilted downward in a direction from the front side to the rear side of the washing machine. That is, one end of the connection guide portion 165 connected to the auxiliary laundry inlet may be located at a higher position than the other end of the connection guide portion 165. Through the above structure, laundry may be easily introduced into the first drum 110 through the auxiliary laundry inlet.

Although the above-mentioned embodiment has disclosed that the auxiliary door 164 is provided at the first door 160 for convenience of description, the scope or spirit of the present disclosure is not limited thereto, and the first door 150 may also be configured not to have the auxiliary laundry inlet, the auxiliary door, the connection guide portion, etc.

The first washing device 10 may include a diaphragm 121 disposed between the first inlet 41 of the front cover 40 and an opening of the first tub 120. The diaphragm 121 may form a passage from the first inlet 41 to the opening of the first tub 120. During rotation of the first drum 110, the diaphragm 121 may reduce vibration delivered to the front cover 40. Some parts of the diaphragm 121 may be disposed between the first door 160 and the front cover 40 so as to prevent wash water of the first tub 120 from leaking outside the washing machine 1.

The second washing device 20 may include a second drum 210 having a second washing space therein, and a second tub 220 having the second drum 210 to store either wash water to be used in a washing process or rinse water to be used in a rinsing process. Each of the second drum 210 and the second tub 220 may be formed in a cylindrical shape, at least a part of one surface of which is opened. The open surface is arranged to face forward.

The second washing device 20 may include a second housing 230. In detail, the second housing 230 may include a lower frame 231 supporting the second tub 220, a second inlet 234 through which laundry is introduced into a second washing space, and an upper frame 232 seated on the lower frame 231. Further, the second housing 230 may include a side cover 233 forming external appearance of a left side surface and a right side surface of the second washing device 20.

The second washing device 20 may include a second door 260 to open or close the second inlet 234. The second door 260 may be provided to correspond to the second inlet 234, and may be pivotably movable with respect to the upper frame 232. The second door 260 may include a second door frame 261 and a second door cover 262. The second door cover 262 may be formed of transparent material such that a user who is located outside the washing machine 1 may view inner spaces of the second tub 220 and the second drum 210 even when the second door 260 closes the second inlet 234.

A second hinge is provided at right and left sides of the second door frame 261 to allow the second door 260 to pivot with respect to the upper frame 232, and is coupled to a second hinge coupling portion formed in the vicinity of the second inlet 234. A latch container 263 is provided at a front side of the second door frame 261, and the upper frame 232 is provided with a latch device formed at a position corresponding to the latch container 263 of the second door frame 261, such that the second door 260 closes the second inlet 234 and is kept locked during operation of the second washing device 20.

The second drum 210 may be formed in a cylindrical shape, a top surface of which is opened, and may be rotatable in the second tub 220. A plurality of second through-holes 211 through which wash water passes may be formed at a side surface and a bottom surface of the second drum 210. A second balancer 212 may be mounted to an upper portion of the second drum so that the second drum 210 may stably rotate at a high speed. A filter 300 may be attached to an inner side surface of the second drum 210 so that the filter 300 may filter out contaminants generated in a washing process.

A bent portion 213 producing a water current may be formed at a bottom surface of the second drum 210. Although not shown in the drawings, the second washing device 20 may further include a pulsator that is disposed in the second drum 210 to produce a water current.

The second tub 220 may be formed in a cylindrical shape, and may be supported by the lower frame 231 via a suspension device 250. In detail, the second tub 220 may be supported while being suspended from the lower frame 232 by four suspension devices 250. A third inlet 214 may be provided to correspond to the second inlet 234 at a top surface of the second tub 220, and a third door 280 may be coupled to the third inlet 214 so as to open or close the third inlet 214.

The third door 280 may include a third door frame 281 and a third door cover 281. The third door cover 282 may be formed of transparent material such that a user who is located outside the second tub 220 may view an inner space of the second drum 210 even when the third door 280 closes the third inlet 214.

A third hinge may be provided in the vicinity of the third inlet 214 so as to pivot the third door 280 with respect to the second tub 220, and may be coupled to a third hinge coupling portion formed at one side of the third door frame 281. A knob 283 capable of opening the third door 280 may be provided at the other side of the third door frame 281, and the knob 283 may be provided with a second hook 284. The second tub 220 may include a second hook container formed at a position corresponding to the second hook 284, such that the third door 280 closes the third inlet 214 and is kept locked. When a user pulls the knob 283, the second hook 284 is released from the second hook container so that the third door 280 is opened.

The second washing device 20 may include a second drive motor 240 that is disposed outside a lower side of the second tub 220 and rotates the second drum 210. A second drive shaft 241 for carrying power of the second drive motor 240 may be connected to a bottom surface of the second drum 210. One end of the second drive shaft 241 may be connected to a bottom plate of the second drum 210, and the other end of the second drive shaft 241 may extend outside a lower sidewall of the second tub 220. When the second drive motor 240 drives the second drive shaft 241, the second drum 210 connected to the second drive shaft 241 may rotate around the second drive shaft 241.

Although not shown in the drawings, when the pulsator is disposed at the bottom surface of the second drum 210, the second washing device may further include a power switching device that is capable of simultaneously or selectively transmitting drive power generated by the second drive motor 240 to the second drum 210 and/or the pulsator.

The second washing device 20 may include a function of washing laundry with hot water. In order to obtain hot water, the second tub 220 may be provided with a second heater 290 installed at the bottom surface thereof so as to heat wash water or rinse water stored in the second tub 220.

A second drain pump 270 for discharging water in the second tub 220 to the outside of the washing machine 1 may be disposed in the first washing device 10. In detail, the first washing device 10 may include a second drain pump 270 disposed at an upper portion of the first housing 130, and may include a second drain hose 272 that guides water pumped by the second drain pump 270 to the outside of the washing machine 1.

A second drain hole 273 configured to discharge water in the second tub 220 may be formed at the bottom surface of the second tub 220. The second drain hole 273 may be connected to the second drain pump 270 by a second connection hose 271 so as to allow the water in the second tub 220 to be introduced into the second drain pump 270.

The second washing device 20 may include a water supply device 400 capable of supplying wash water to the second tub 220 and the first tub 120 of the first washing device 10. The water supply device 400 may be disposed in the first housing 230. In detail, the water supply device 400 may be disposed in the upper frame 232. Preferably, the water supply device 400 may be disposed at a rear of the second inlet 234.

The second washing device 20 may include a detergent supply device 500 configured to supply detergent to the first washing device 10. The detergent supply device 500 may be disposed in the first housing 230. In detail, the detergent supply device 500 may be disposed in the upper frame 232. Preferably, the detergent supply device 500 may be disposed at a front of the second inlet 234.

The washing machine 1 may include a control panel 50 that is disposed at an upper portion of the front cover 40 to control the first washing device 10 and the second washing device 20. The control panel 50 may include an input portion 51 to receive an operation command of the washing machine 1 from the user, and a display 52 to display operation information of the washing machine 1. In this case, the input portion 51 and the display 52 may also be implemented as one touchscreen as necessary.

For convenience of description and better understanding of the present disclosure, it is assumed that the control panel 50 is implemented as a touchscreen.

FIG. 4A is an exemplary view illustrating the control panel 50 when the washing machine 1 is powered off.

Referring to FIG. 4A, the control panel 50 may be divided into a first region $S_1$ displaying various kinds of information related to the first washing device 10, and a second region $S_2$ displaying various kinds of information related to the second washing device 20.

A power icon P to power on or off the washing machine 1 may be displayed at a center of the control panel 50. When the user touches the power icon P, the control panel 50 may receive a turn-on command (i.e., power-ON command) of the washing machine 1.

FIG. 4B is an exemplary view illustrating the control panel 50 achieved when the washing machine 1 is powered on.

When the control panel 50 receives the power-ON command by the user who touches the power icon P, the washing machine 1 may be powered on. As a result, the control panel 50 may display various kinds of selectable objects thereon.

Referring to FIG. 4B, the first region $S_1$ may include a start icon $St_1$ through which a washing process in the first washing device 10 is started or stopped, a mode icon $M_1$ through which a washing mode to be performed by the first washing device 10 is selected, an option icon $O_1$ through which an option to be additionally performed in the washing process based on the selected mode is selected, a target temperature setting environment entry icon $I_1$ through which the user enters a target temperature setting environment of wash water of the first washing device 10, a target temperature setting icon $I_{11}$ through which a target temperature is set in the range of the target temperature setting environment, a rotation speed icon $I_2$ through which a rotation speed of the first drum of the first washing device 10 is selected, a soil level icon $I_3$ through which the degree of contamination of laundry stored in the first washing device 10 is selected, and a numerical information display region $T_1$ displaying various kinds of numerical information related to the first washing device 10.

The first region $S_1$ may further display activation indicators $L_{11}$ and $L_{12}$ indicating activation states, a selection mode indicator $L_{13}$ indicating selectable modes, a selection rotation speed indicator $L_{14}$ indicating selectable rotation speeds of the first drum, and a selection soil level indicator $L_{15}$ indicating selectable soil levels of laundry stored in the first washing device 10.

In this case, an aggregate or set of the mode icon $M_1$ and the selection mode indicator $L_{13}$ will hereinafter be referred to as a first washing mode selection menu. An aggregate or set of the target temperature setting environment entry icon $I_1$, the target temperature setting icon $I_{11}$, and the numerical information display region $T_1$ will hereinafter be referred to as a target temperature setting menu.

The second region $S_2$ may include a start icon $St_2$ through which a washing process in the second washing device 20 is started or stopped, a mode icon $M_2$ through which a washing mode of laundry stored in the second washing device 20 is selected, an option icon $O_2$ through which an option to be additionally performed in the washing process based on the selected mode is selected, and a numerical information display region $T_2$ displaying various kinds of numerical information related to the second washing device 20.

The second region $S_2$ may further display activation indicators $L_{21}$ and $L_{22}$ indicating activation states, a selection mode indicator $L_{23}$ indicating selectable modes, and the like.

In this case, an aggregate or set of the mode icon $M_2$ and the selection mode indicator $L_{23}$ will hereinafter be referred to as a second washing mode selection menu.

When a power-ON command is input to the washing machine 1, the control panel 50 may activate both the first region $S_1$ and the second region $S_2$, and may deactivate a region in which a touch action is not detected within a predetermined time. After the first region $S_1$ or the second region $S_2$ is transitioned to a deactivated state, when a touch action is detected in the deactivated region, the control panel 50 may re-activate the touched region.

In the meantime, the above-mentioned washing machine 1 may supply a power-supply voltage supplied through a single power-supply cable to each of the first washing device 10 and the second washing device 20. In this case, the power-supply cable may have a limit current at which the washing machine 1 may normally operate, and the limit current may be predetermined in a manufacturing process of the washing machine 1. An electrical outlet directly connected to the power-supply cable may also have a limit current. A current interrupter provided on a route through which external power source is transmitted to an electric outlet installed at home may have an interruption current. When a current higher than the interruption current flows in the washing machine 1, the current interrupter may interrupt the power-supply route.

As a result, the washing machine 1 according to the embodiment needs to receive a current less than a reference current that is a minimum value from among a limit current of the power-supply cable, a limit current of the electric outlet connected to the power-supply cable, and an interruption current of the home current interrupter.

However, when the washing machine 1 includes a plurality of washing devices, it may be necessary for the washing machine 1 to receive a current equal to or higher than the reference current. In more detail, a current needed to simultaneously drive heaters respectively mounted to the plurality of washing devices may be equal to or higher than the reference current. In this case, the power-supply cable may fail to normally operate due to overcurrent, the electric outlet connected to the power-supply cable may malfunction, or a current supplied to the washing machine 1 may be interrupted by the home current interrupter.

Therefore, the washing machine according to the embodiment needs to control the plurality of washing devices in different ways so as to prevent heaters respectively mounted to the washing devices from simultaneously operating. The washing machine 1 for controlling the control panel 50 so as to prevent supply of an overcurrent will hereinafter be described.

Figure 5:
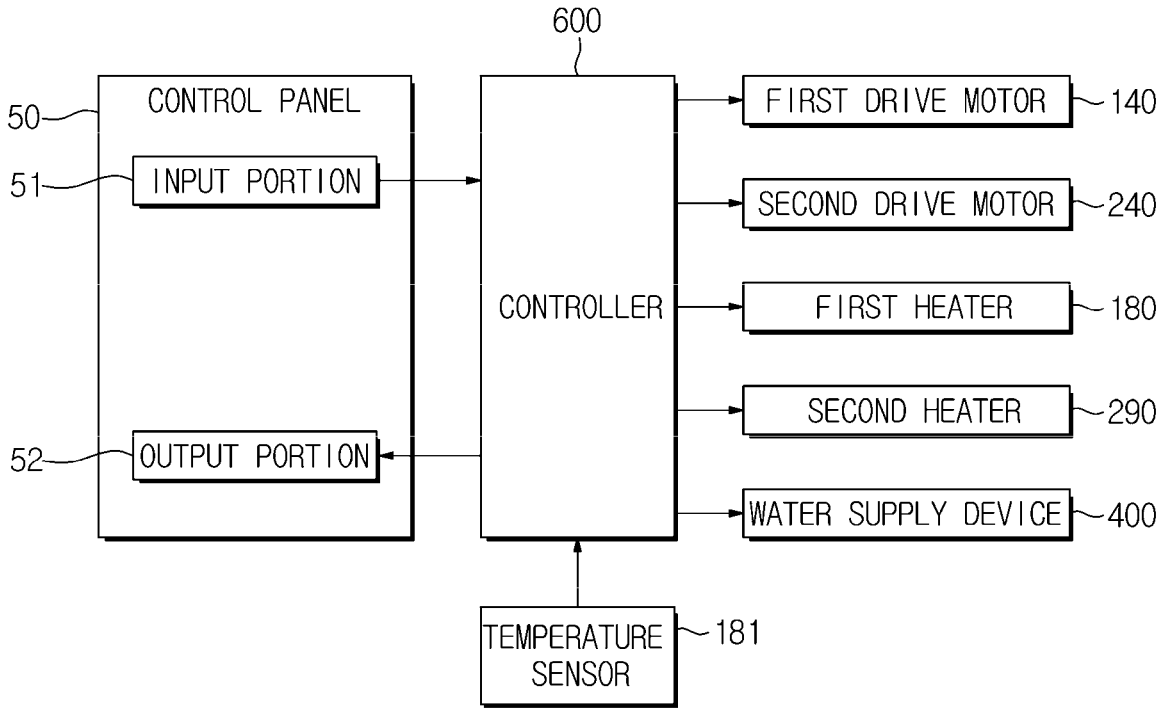
FIG. 5 is a control block diagram illustrating a washing machine according to an embodiment of the present disclosure.

FIG. 5 is a control block diagram illustrating the washing machine according to an embodiment of the present disclosure.

Referring to FIG. 5, the washing machine 1 may include a first drive motor configured to supply rotational force to the first tub of the first washing device 10, a second drive motor configured to supply rotational force to the second tub of the second washing device 20, a first heater 180 configured to heat wash water stored in the first tub of the first washing device 10, a second heater 290 configured to heat wash water stored in the second tub of the second washing device 20, a water supply device 400 configured to supply wash water to at least one of the first tub and the second tub, a temperature sensor 181 configured to detect a temperature of the wash water stored in the first tub, a control panel 50 configured to perform input/output (I/O) operations for the washing machine 1, and a controller 600 configured to control the above constituent elements of the washing machine 1.

The first drive motor, the second drive motor, the first heater 180, the second heater 290, the water supply device 400, the temperature sensor 181, and the control panel 50 shown in FIG. 5 are identical to those of FIGS. 1, 2, 3, 4A and 4B. A method for controlling the control panel 50 so as to prevent supply of an overcurrent according to the embodiment of the present disclosure will hereinafter be described with reference to operations of the controller 600.

When any one of the first heater 180 and the second heater 290 is first driven, the controller 600 may control the control panel 50 so that the user is unable to input a control command for driving the remaining one other than the first-driven heater to the washing machine by a drive current higher than a difference between a predetermined reference current and a drive current being supplied to the first-driven heater.

A method for allowing the controller 600 to control the control panel 50 during operation of the first heater 180 will hereinafter be described with reference to FIGS. 6A and 6B. A method for allowing the controller 600 to control the control panel 50 during operation of the second heater 290 will hereinafter be described with reference to FIGS. 7A to 7C.

Figure 6A:
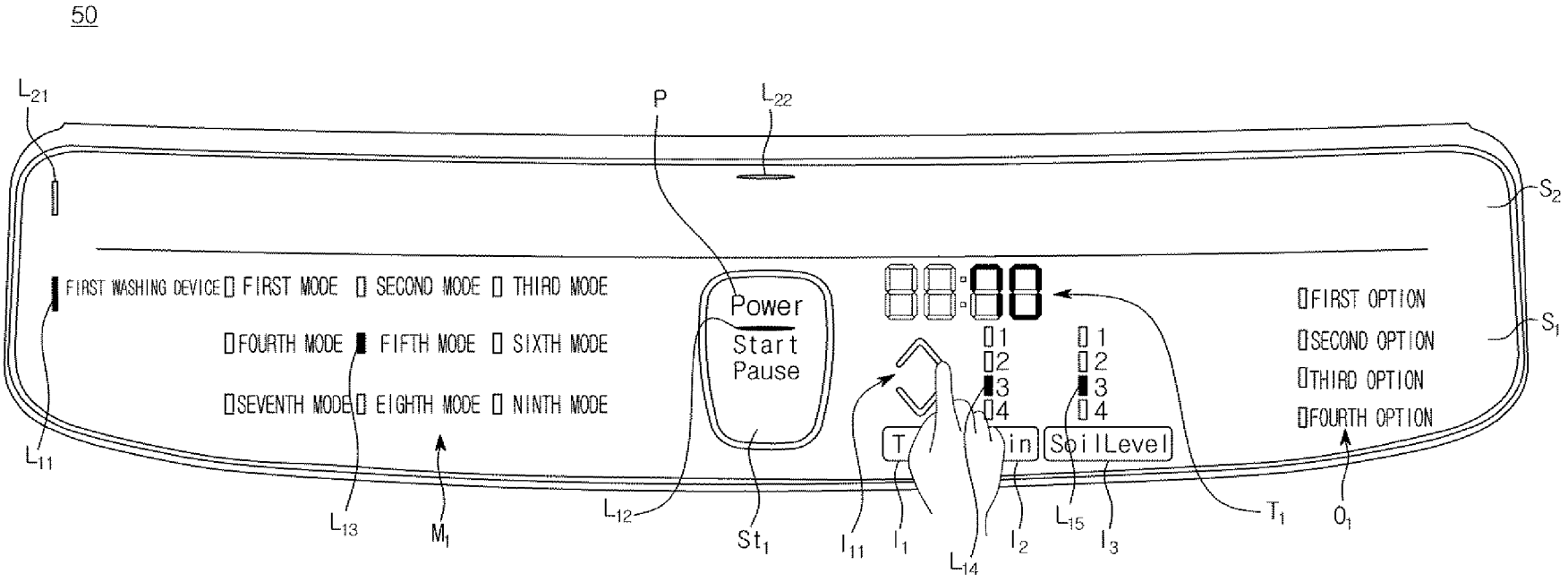
FIGS. 6A and 6B are views illustrating methods for allowing a controller to control a control panel during operation of a first heater according to an embodiment of the present disclosure.
Figure 6B:
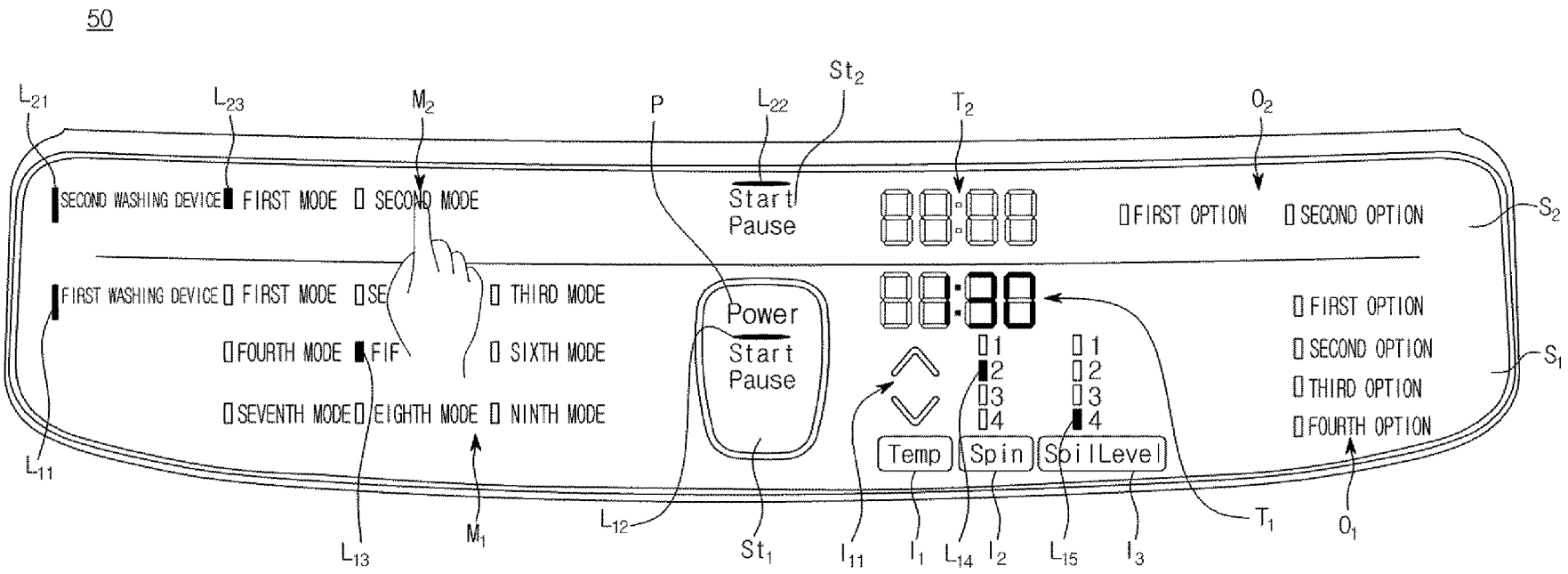

FIGS. 6A and 6B are views illustrating methods for allowing the controller to control the control panel during operation of the first heater according to an embodiment of the present disclosure.

In FIG. 6A, the first region $S_1$ is in an activation state, and the second region $S_2$ is in a deactivation state. As can be seen from FIG. 6A, a fifth mode for the first washing device 10 is selected, and an option menu for the first washing device 10 is not selected. In this case, the user may input a target temperature setting command by touching the target temperature setting icon $I_{11}$ on the control panel 50. As a result, the washing machine 1 may set a target temperature of wash water stored in the first tub. The control panel 50 may display the set target temperature on the numerical information display region $T_1$. For example, as shown in FIG. 6A, the target temperature of wash water stored in the first tub may be set to 70° C.

Thereafter, when the user inputs a command for starting a washing process of the first washing device 10 by touching the start icon $St_1$ of the control panel 50, the first washing device 10 may perform the washing process according to the set mode and the set target temperature. In this case, the controller 600 may drive the first heater 180 in a manner that wash water stored in the first tub reaches the set target temperature. In more detail, the controller 600 may supply a drive current corresponding to a predetermined first target temperature to the first heater 180, and the first heater 180 may heat wash water according to the supplied drive current.

During operation of the first heater 180, user's touch on the second region $S_2$ of the control panel 50 may be detected, such that the second region $S_2$ may be activated by the user's touch. As a result, the control panel 50 may provide a second washing mode selection menu. FIG. 6B illustrates an exemplary case in which the second region $S_2$ is activated.

When the second region $S_2$ is activated, the controller 600 may control the second region $S_2$ of the control panel 50 to prevent a current higher than a reference current from being supplied to the washing machine 1. In this case, the reference current may refer to a minimum current at which the washing machine 1 is unable to normally operate. In this embodiment, the reference current may be set to a minimum value from among a limit current of the power-supply cable, a limit current of the electric outlet connected to the power-supply cable, and an interruption current of the home current interrupter. In contrast, the reference current may be predetermined in a manufacturing process of the washing machine, or may also be determined by an external input or internal operation of the washing machine 1 after completion of the manufacturing process.

In order to prevent a current higher than the reference current from being supplied to the washing machine 1, the controller 600 may control the second region $S_2$ of the control panel 50 in a manner that a control command for driving the second heater 290 is not input to the washing machine by a second drive current that is equal to or higher than a difference between the reference current and the first drive current supplied to the first heater 180. In detail, the controller 600 may limit the first washing mode selection menu according to the first target temperature so that the user is unable to select a mode in which heating of wash water is needed.

For example, the mode icon $M_2$ of the second region $S_2$ may include a first mode icon for selecting a first mode in which the second heater 290 is not driven, and a second mode icon for selecting a second mode in which the second heater 290 is driven. In this case, when the second washing device 20 starts washing according to the second mode, the second heater 290 may be driven by the second drive current higher than a difference between the reference current and the first drive current.

If a command for selecting the second mode is input to the control panel 50 and the second washing device 20 performs washing, an overcurrent may occur in the washing machine 1 so that internal constituent elements of the washing machine 1 may be damaged or current interruption may occur. In order to address the issues, the controller 600 may control the control panel 50 to forbid the user to input the second mode selection command to the washing machine 1.

Referring to FIG. 6B, although the user touches an icon corresponding to the second mode, the control panel 50 continuously displays only selection of the first mode through the selection mode indicator $L_{23}$. That is, upon receiving a control signal from the controller 600, the control panel 50 does not recognize the user's touch on the second mode icon as the second mode selection command, such that the user is unable to input the second mode selection command through the control panel 50.

In contrast, the control panel 50 may not display the second mode icon thereon. As a result, the user is unable to touch the second mode icon, such that the second command selection command is not input to the washing machine 1.

Figure 7A:
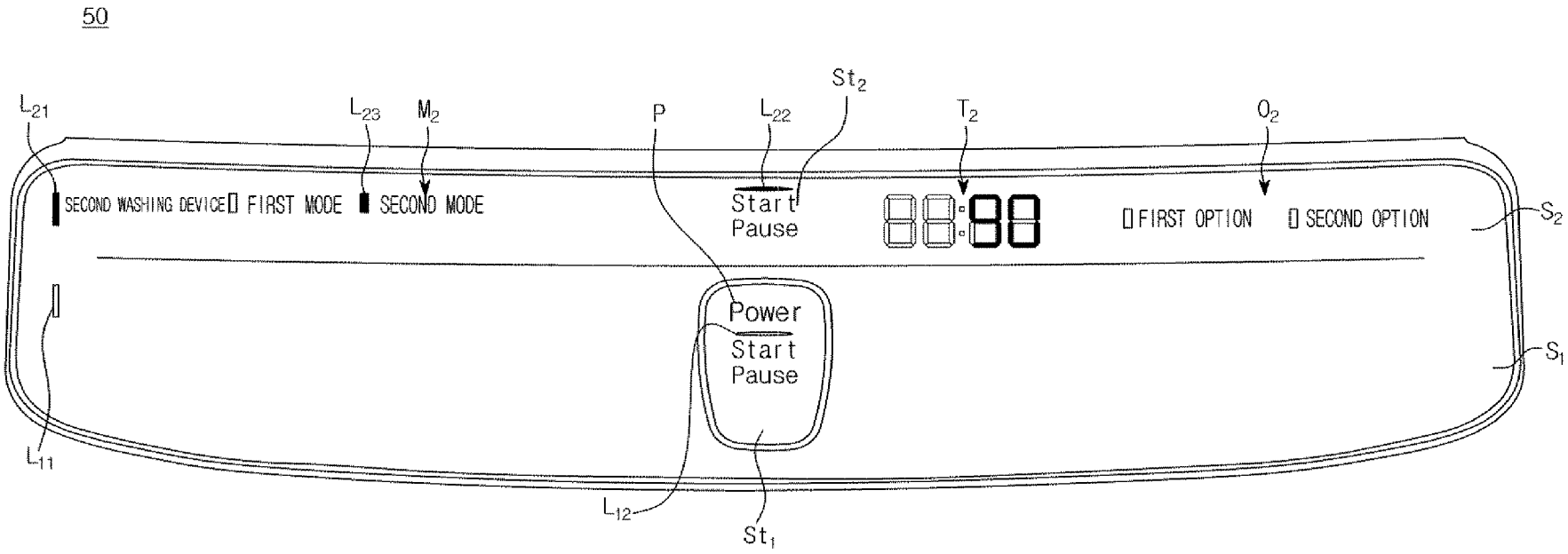
FIGS. 7A, 7B and 7C are views illustrating methods for allowing a controller to control a control panel during operation of a second heater according to an embodiment of the present disclosure.
Figure 7B:
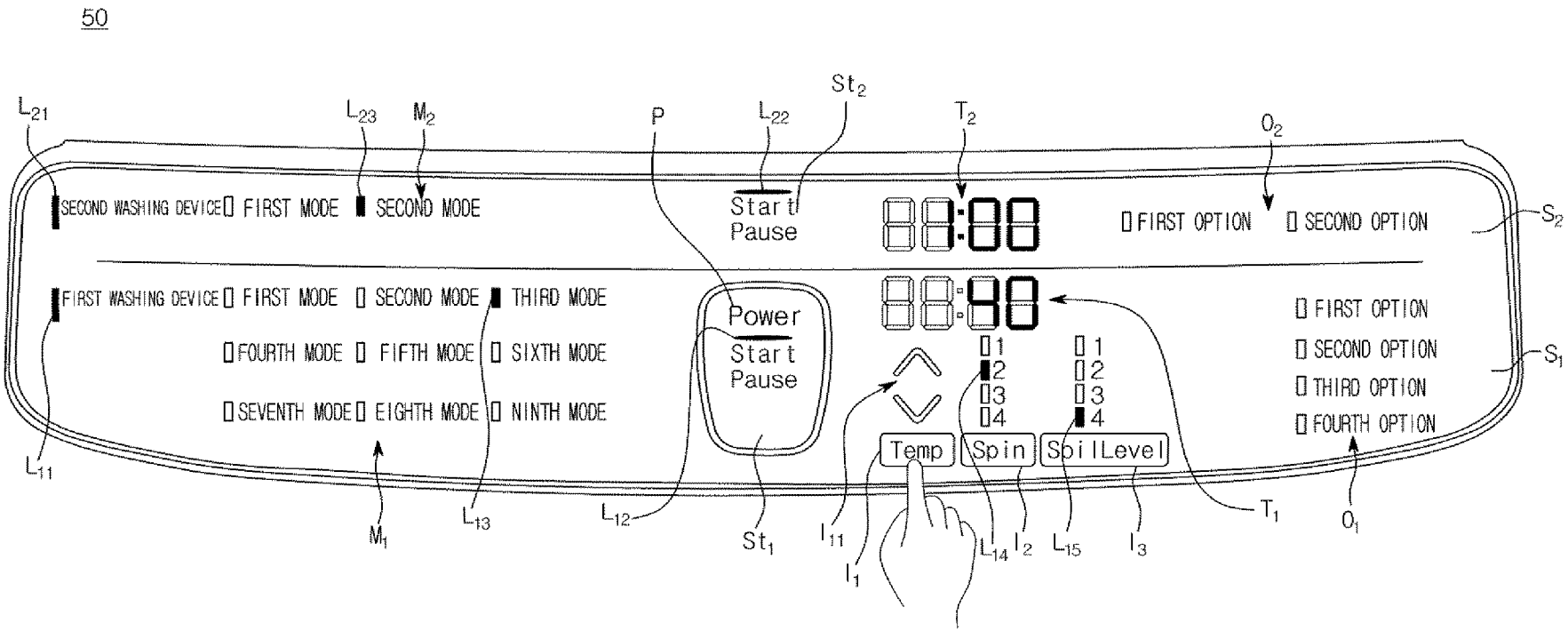
Figure 7C:
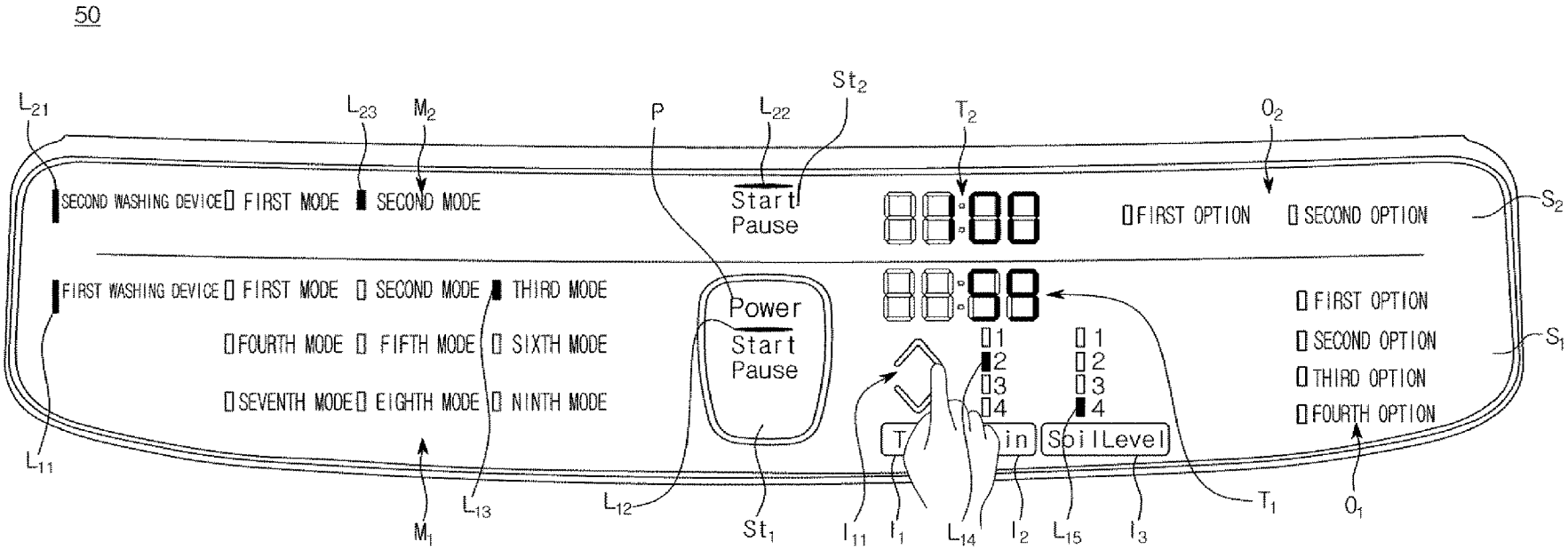

FIGS. 7A to 7C are views illustrating methods for allowing the controller to control the control panel during operation of the second heater according to an embodiment of the present disclosure.

In FIG. 7A, the second region $S_2$ is in an activation state, and the first region $S_1$ is in a deactivation state. As can be seen from FIG. 7A, the second mode for the second washing device 20 is selected, and an option menu for the second washing device 20 is not selected. As described above, since the second heater 290 is driven by selection of the second mode, a target temperature (i.e., a second target temperature) of wash water stored in the second tub may be displayed on the numerical information display region $T_2$. For example, as shown in FIG. 7A, the second target temperature of wash water stored in the second tub may be set to 90° C.

Thereafter, when the user inputs a command for starting a washing process of the second washing device 20 by touching the start icon $St_e$ of the control panel 50, the second washing device 20 may perform the washing process according to the set mode. As a result, the controller 600 of the second washing device 20 may drive the second heater 290 in a manner that wash water stored in the second tub reaches the target temperature of the second mode. In detail, the controller 600 may supply a drive current corresponding to the second target temperature of the second mode to the second heater 290, and the second heater 290 may heat wash water according to the supplied drive current.

During operation of the second heater 290, user's touch on the first region $S_1$ of the control panel 50 may be detected, such that the first region $S_1$ may be activated by the user's touch. As a result, the control panel 50 may provide a first washing mode selection menu and a target temperature setting menu. FIG. 7B illustrates an exemplary case in which the first region $S_1$ is activated. As can be seen from FIG. 7B, the user may visually recognize selection of a third mode of the first washing device 10.

In this case, the controller 600 may control the first region $S_1$ of the control panel 50 to prevent a current equal to or higher than a reference current from being supplied to the washing machine 1. In detail, the controller 600 may control the first region $S_1$ of the control panel 50 to prevent a control command for driving the first heater 180 from being input by the first drive current that is equal to or higher than a difference between the reference current and the second drive current supplied to the second heater 290. In more detail, the controller 600 may change the target temperature setting menu supplied from the control panel in response to the second target temperature.

The first heater 180 is driven by the first drive current based on the first target temperature, such that the controller 600 may control the first region $S_1$ of the control panel 50 such that a target temperature corresponding to the first drive current higher than the difference between the reference current and the second drive current is prevented from being set. In detail, when the second target temperature is equal to or higher than a predetermined second threshold temperature, the controller 600 may limit the target temperature setting menu to prevent the first target temperature from being equal to or higher than the first threshold temperature. Here, within a technical scope, in which the sum of the first drive current corresponding to the first threshold temperature and the second drive current corresponding to the second threshold temperature is less than the reference current, is satisfied, the first threshold temperature and the second threshold temperature may be decided.

Prior to execution of the above-mentioned operations, the controller 600 may display a standard target temperature on the numerical information display region $T_1$ when entering the target temperature setting environment, such that the controller 600 may guide the user to set a target temperature corresponding to the first drive current less than the difference between the reference current and the second drive current in the target temperature setting environment.

For example, the control panel 50 may detect user's touch on the target temperature setting environment entry icon $I_1$, and may thus receive a target temperature setting environment entry command from the user. As a result, the control panel 50 may enter the target temperature setting environment to receive the target temperature setting command. In this case, the numerical information display region $T_1$ of the control panel 50 may display the standard target temperature to guide the user to set a target temperature capable of preventing overcurrent.

If the target temperature corresponding to the first drive current identical to the difference between the reference current and the second drive current is set to 60° C., the numerical information display region $T_1$ may display a standard target temperature less than 60° C., corresponding to the first drive current less than the difference between the reference current and the second drive current. FIG. 7B illustrates an exemplary case in which the numerical information display region $T_1$ displays a standard target temperature of 40° C.

When the standard target temperature is displayed on the numerical information display region $T_1$, the user may input a target temperature setting command by touching the target temperature setting icon $I_{11}$. In this case, the controller 600 may control the first region $S_1$ of the control panel 50 to prevent the user from setting a target temperature corresponding to the first drive current that is equal to or higher than the difference between the reference current and the second drive current.

If the target temperature corresponding to the first drive current identical to the difference between the reference current and the second drive current is set to 60° C., the first threshold temperature may be set to 60° C. As a result, the controller 600 may control the first region $S_1$ of the control panel 50 to prevent a temperature of at least 60° C. indicating the first threshold temperature from being set to a target temperature. Referring to FIG. 7C, although the user desires to set the temperature of at least 60° C. to a target temperature by touching the target temperature setting icon the control panel 50 does not recognize the user's touch on the target temperature setting icon $I_{11}$ as the target temperature setting command, such that the user is unable to input a command for setting the target temperature of 60° C. or higher through the control panel 50. As a result, the numerical information display region $T_1$ may display a target temperature of 59° C., which is less than 60° C.

As described above, during operation of the second heater 290, the user who uses the control panel 50 may set only a target temperature corresponding to the first drive current less than the difference between the reference current and the second drive current. After completion of the setting of the target temperature, the user may input a washing start command by touching the start icon $St_1$ needed to start a washing process of the first washing device 10.

When the user inputs a washing start command for the first washing device 10 during operation of the second heater 290, the controller 600 may sequentially drive the first heater 180 and the second heater 290 according to predefined priority. In detail, the controller 600 may control the first heater 180 and the second heater 290 such that wash water of the first washing device 10 may reach the first target temperature before wash water of the second washing device 20 reaches the second target temperature.

Figure 8:
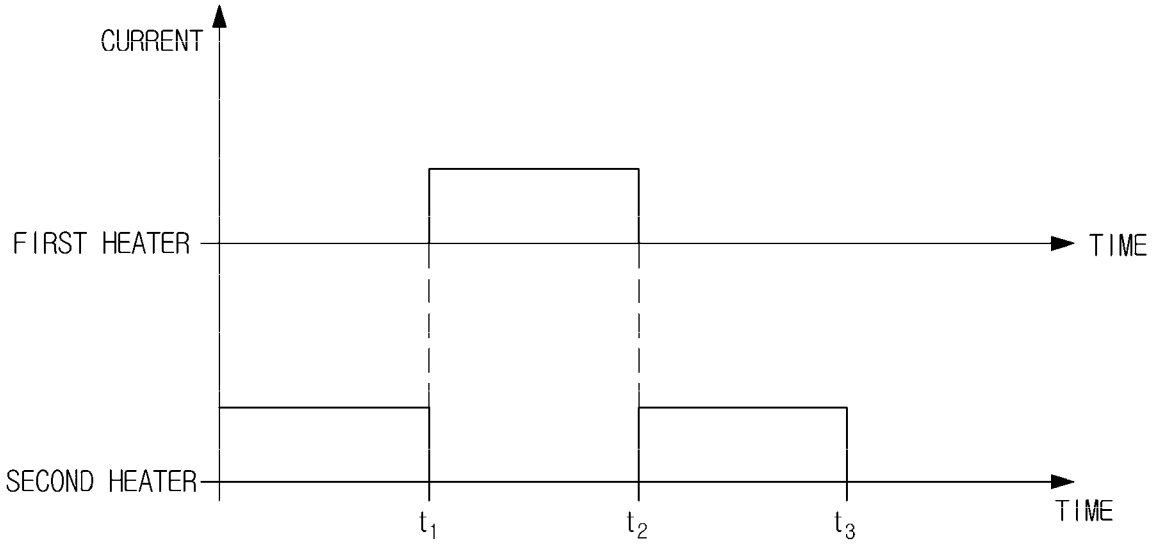
FIG. 8 is a graph illustrating drive currents supplied to a first heater and a second heater according to lapse of time according to an embodiment of the present disclosure.

FIG. 8 is a graph illustrating drive currents supplied to the first heater and the second heater according to lapse of time according to an embodiment of the present disclosure.

Referring to FIG. 8, the second drive current may first be supplied to the second heater 290. As a result, the second heater 290 is first driven by the second drive current.

During operation of the second heater 290, when a washing start command for the first washing device 10 is input at a time ($t_1$), the controller 600 may stop operation of the second heater 290 by interrupting the second drive current supplied to the second heater 290.

Thereafter, the controller 600 may drive the first heater 180 by supplying the first drive current to the first heater 180. In this case, the controller 600 may recognize a temperature of wash water stored in the first tub using the temperature sensor. If wash water stored in the first tub reaches a target temperature at a time ($t_2$), the controller 600 may stop operation of the first heater 180 by interrupting the first drive current supplied to the first heater 180.

After the first heater 180 stops operation, the controller 600 may re-supply the second drive current to the second heater 290 such that the second heater 290 is re-driven. The controller 600 may supply the second drive current to the second heater 290 during a predetermined drive time, and may interrupt the second drive current at a time ($t_3$) at which the amount of the second drive current supplied to the second heater 290 is considered sufficient, such that the controller 600 may stop operation of the second heater 290.

As a result, the washing machine 1 may prevent the first heater 180 and the second heater 290 from being simultaneously driven, such that overcurrent is prevented from flowing into the washing machine 1.

Although the above-mentioned embodiments of the present disclosure have disclosed that the control panel 50 is implemented as a touchscreen for convenience of description and better understanding of the present disclosure, the controller 600 may also control the control panel 50 even when the input portion 51 is implemented as buttons. For example, the controller 600 may control the control panel 50 to prevent the user from inputting a specific control command, such that, although the user touches a button corresponding to the specific control command, the controller 600 does not recognize the user's touch as the specific control command.

The embodiments of the present disclosure have exemplarily disclosed the method for controlling the control panel 50 to prevent overcurrent caused by operations of the first heater 180 and the second heater 290 by the controller 600 for convenience of description and better understanding of the present disclosure. In contrast, the controller 600 may also control the control panel 50 to prevent overcurrent caused by simultaneous operation of one component of the first washing device 10 and one component of the second washing device 20.

For example, assuming that the first tub rotates at a specific speed according to a third drive current supplied to the first drive motor 140 of the first washing device 10, the controller 600 may control the control panel 50 such that the user is unable to input a control command for rotating the second tub at a speed corresponding to a fourth drive current that is equal to or higher than a difference between the reference current and the third drive current.

Figure 9:
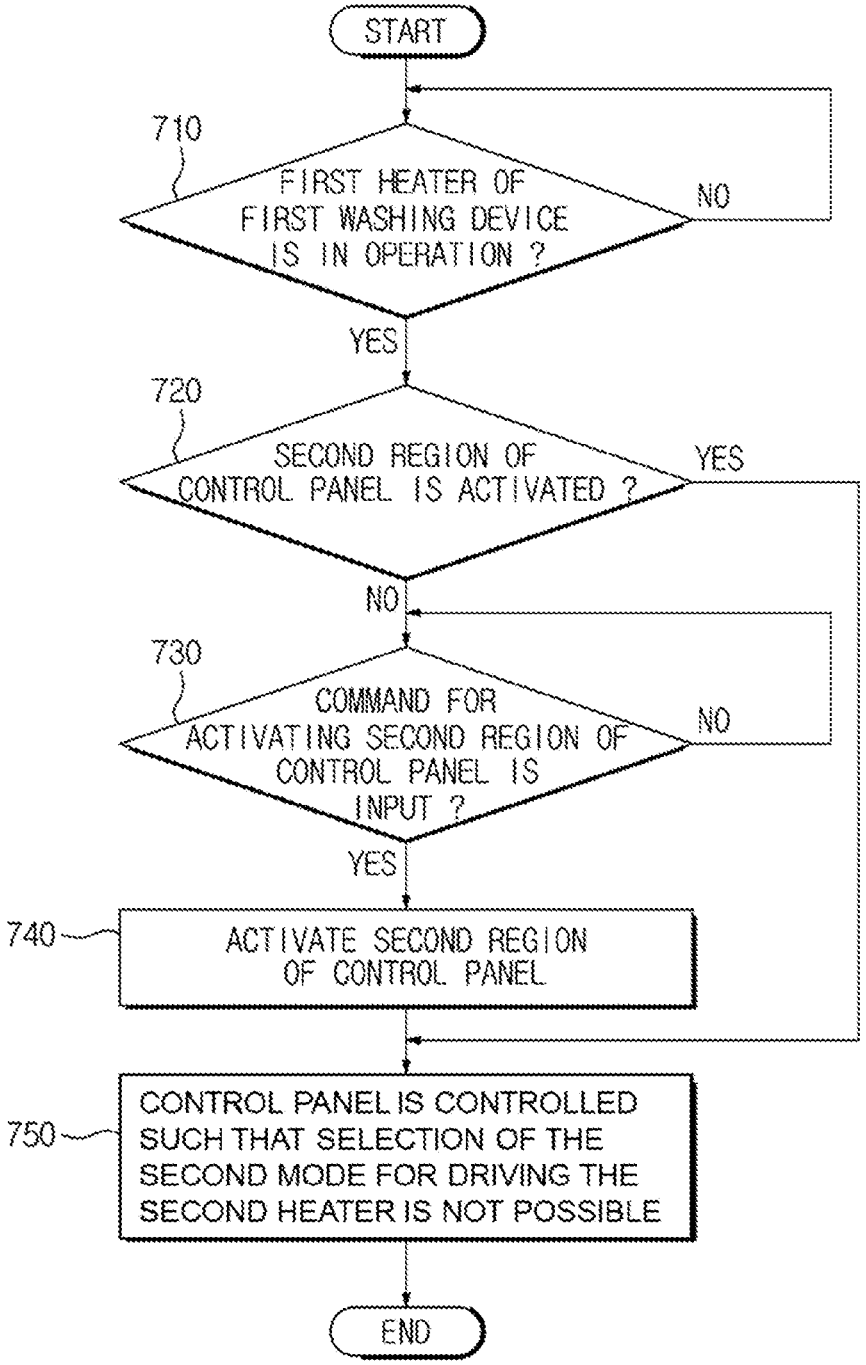
FIG. 9 is a flowchart illustrating a method for controlling a washing machine according to an embodiment of the present disclosure.

FIG. 9 is a flowchart illustrating a method for controlling the washing machine according to an embodiment of the present disclosure.

Referring to FIG. 9, the washing machine 1 may determine whether the first heater 180 of the first washing device 10 is in operation (710). If the first heater 180 is not in operation, the washing machine 1 may repeatedly perform the operation 710.

In contrast, if the first heater 180 is in operation, the washing machine 1 may determine whether the second region of the control panel 50 is in an activation state (720). Here, the second region may refer to a region in which the washing machine 1 is able to receive a control command for controlling the second washing device 20. The activation state may refer to a state in which the user is able to input the control command.

If the second region of the control panel 50 is not in the activation state, the washing machine 1 may determine whether a command for activating the second region of the control panel 50 is input (730). If the activation command is not input, the washing machine 1 may repeatedly perform the operation 730.

In contrast, if the activation command is input (730), the washing machine 1 may activate the second region of the control panel 50 (740).

If the second region of the control panel 50 is activated, or if the second region of the control panel 50 is activated by the activation command, the washing machine 1 may control the control panel 50 to prevent the user from selecting the second mode in which the second heater 290 of the second washing device 20 is driven (750). For example, upon receiving a control signal from the controller 600 of the washing machine 1, the washing machine 1 may not recognize user's touch on the second mode icon as the second mode selection command, or may not display the second mode icon on the control panel 50.

As a result, during operation of the first heater 180, it is impossible for the user to input a control command through which laundry is washed in a washing mode in which the second washing device 20 drives the second heater 290. As a result, overcurrent caused by simultaneous operation of the first and second heaters 180 and 290 is prevented from flowing into the washing machine.

Figure 10:
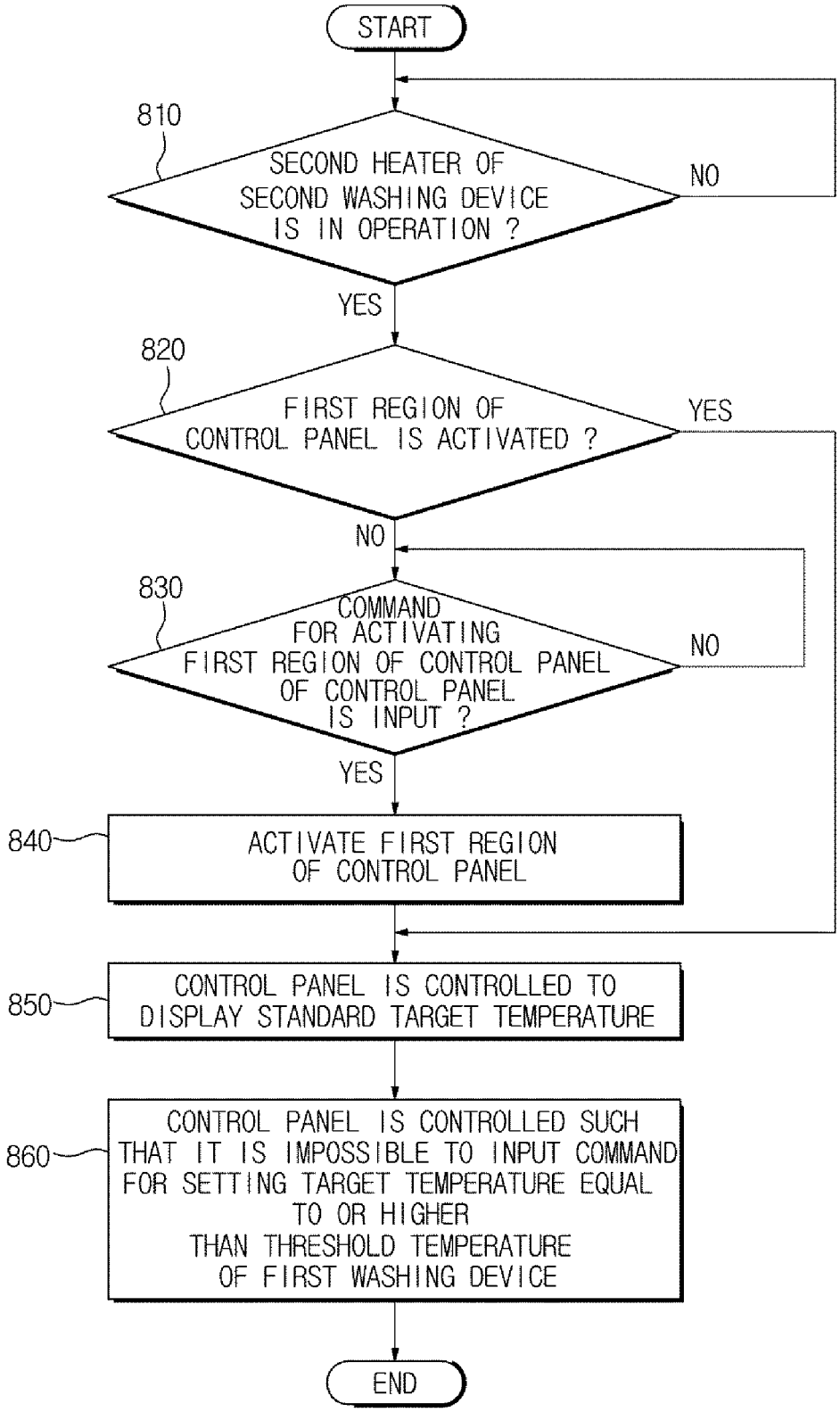
FIG. 10 is a flowchart illustrating a method for controlling a washing machine according to another embodiment of the present disclosure.

FIG. 10 is a flowchart illustrating a method for controlling the washing machine according to another embodiment of the present disclosure.

Referring to FIG. 10, the washing machine 1 may determine whether the second heater 290 of the second washing device 20 is in operation (810). If the second heater 290 is not in operation, the washing machine 1 may repeatedly perform the operation 810.

In contrast, if the second heater 290 is in operation, the washing machine 1 may determine whether the first region of the control panel 50 is in an activation state (820). Here, the first region may refer to a region in which the washing machine 1 is able to receive a control command for controlling the first washing device 10. The activation state may refer to a state in which the user is able to input the control command.

If the first region of the control panel 50 is not in the activation state, the washing machine 1 may determine whether a command for activating the first region of the control panel 50 is input (830). If the activation command is not input, the washing machine 1 may repeatedly perform the operation 830.

In contrast, if the activation command is input (830), the washing machine 1 may activate the first region of the control panel 50 (840).

If the first region of the control panel 50 is activated, or if the first region of the control panel 50 is activated by the activation command, the washing machine 1 may control the control panel 50 to display a standard target temperature (850). Here, the standard target temperature may be set to a temperature value less than a threshold temperature indicating a target temperature corresponding to the first drive current identical to the difference between the reference current and the second drive current.

As a result, the washing machine 1 may guide the user to set the target temperature less than the threshold temperature.

Finally, the washing machine 1 may control the control panel 50 to prevent the user from inputting a command for setting a target temperature that is equal to or higher than the threshold temperature of the first washing device 10 (860). For example, upon receiving a control signal from the controller 600 of the washing machine 1, the control panel 50 may not recognize user's touch on the target temperature setting icon $I_{11}$ for setting a target temperature equal to or higher than the threshold temperature, as the target temperature setting command.

As a result, during operation of the second heater 290, it is impossible for the user to input a control command through which the second washing device 20 performs washing using wash water having a temperature equal to or higher than the threshold temperature. As a result, overcurrent caused by simultaneous operation of the first and second heaters 180 and 290 may be prevented from flowing into the washing machine in advance.

Figure 11:
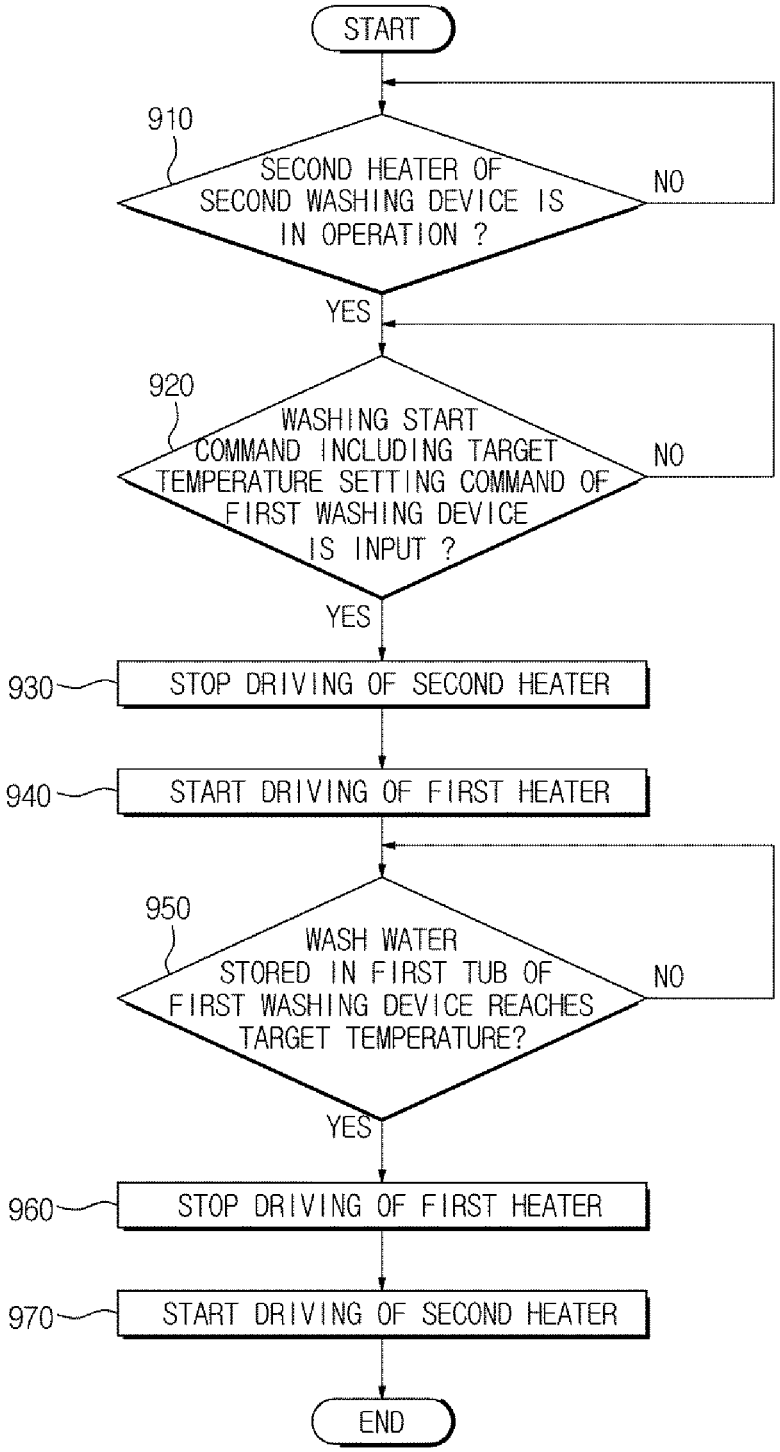
FIG. 11 is a flowchart illustrating a method for controlling a washing machine according to still another embodiment of the present disclosure.

FIG. 11 is a flowchart illustrating a method for controlling a washing machine according to still another embodiment of the present disclosure.

Referring to FIG. 11, the washing machine 1 may determine whether the second heater 290 of the second washing device 20 is in operation (910). If the second heater 290 is not in operation, the washing machine 1 may repeatedly perform the operation 910.

In contrast, if the second heater 290 is in operation, the washing machine 1 may determine whether a washing start command including a target temperature setting command for the first washing device 10 is input (920). If the washing start command is not yet input, the washing machine 1 may repeatedly perform the operation 920.

If the washing start command is input, the washing machine 1 may stop operation of the second heater 290 (930), and the first heater 180 may start operation (940). Although the above operations are sequentially performed as shown in FIG. 11, the scope or spirit of the present disclosure is not limited thereto, and a time point at which the second heater 290 stops operation may be identical to a time point at which the first heater 180 starts operation.

Thereafter, the washing machine 1 may determine whether wash water stored in the first tub of the first washing device reaches a target temperature (950). If wash water stored in the first tub of the first washing device does not reach the target temperature (950), the washing machine 1 may repeatedly perform the operation 950.

In contrast, if wash water stored in the first tub of the first washing device reaches the target temperature (950), the washing machine 1 may stop operation of the first heater 180 (960), and may restart operation of the second heater 290 (970). Although the above operations are sequentially performed as shown in FIG. 11, the scope or spirit of the present disclosure is not limited thereto, a time point at which the first heater 180 stops operation may be identical to a time point at which the second heater 290 restarts operation, As a result, overcurrent caused by simultaneous operation of the first and second heaters 180 and 290 may be prevented from flowing into the washing machine in advance.

As is apparent from the above description, the washing machine and the method for controlling the same according to one embodiment of the present disclosure can provide an environment in which, when a heater of any one of washing devices included in the washing machine is driven, it is impossible for a user to input a command for controlling another washing device having a possibility of causing an overcurrent to the washing machine, such that safety of the washing machine and consumers is guaranteed.

The washing machine and the method for controlling the same according to another embodiment of the present disclosure can sequentially drive respective heaters provided in different washing devices according to predefined priority upon receiving a request for driving the respective heaters, so that overcurrent may be prevented from flowing into the washing machine.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a first heater configured to heat wash water stored in a first tub;

a second heater configured to heat wash water stored in a second tub;

a control panel configured to provide a target temperature setting menu for setting a first target temperature of the wash water stored in the first tub, a first washing mode selection menu including a plurality of first washing modes related to the first tub and a second washing mode selection menu including a plurality of second washing modes related to the second tub; and a controller configured to:

drive the first heater in a manner that the wash water stored in the first tub reaches the first target temperature, and drive the second heater in a manner that the wash water stored in the second tub reaches a second target temperature determined by selection of one of the plurality of second washing modes, limit the target temperature setting menu provided by the control panel, based on the second target temperature, such that the first target temperature is prevented from being set to equal to or higher than a first threshold temperature, and determine the first threshold temperature based on a driving current of the second heater corresponding to the second target temperature and a predetermined reference current.

2. The washing machine according to claim 1, wherein the first tub includes a first laundry inlet disposed at a front part thereof, and wherein the second tub includes a second laundry inlet disposed at an upper part thereof.

3. The washing machine according to claim 1, wherein, when the second target temperature is equal to or higher than a predetermined second threshold temperature, the controller limits the target temperature setting menu to prevent the first target temperature from being set to be equal to or higher than the first threshold temperature.

4. The washing machine according to claim 1, wherein the controller controls driving of the first heater and the second heater in a manner that the wash water stored in the first tub reaches the first target temperature before the wash water stored in the second tub reaches the second target temperature.

5. The washing machine according to claim 1, wherein the plurality of first washing modes includes one mode in which the wash water stored in the first tub needs to be heated and another mode in which the wash water stored in the first tub need not be heated.

6. The washing machine according to claim 5, wherein the controller limits the first washing mode selection menu such that the one mode in which the wash water needs to be heated is prevented from being selected, based on the first target temperature.

7. A method for controlling a washing machine that includes a first heater configured to heat wash water stored in a first tub, a second heater configured to heat wash water stored in a second tub, and a control panel configured to provide a target temperature setting menu for setting a first target temperature of the wash water stored in the first tub, a first washing mode selection menu including a plurality of first washing modes related to the first tub and a second washing mode selection menu including a plurality of second washing modes related to the second tub, the method comprising:

driving the first heater in a manner that the wash water stored in the first tub reaches the first target temperature;

driving the second heater in a manner that the wash water stored in the second tub reaches a second target temperature determined by selection of one of the plurality of second washing modes;

confirming the second target temperature of the wash water stored in the second tub;

limiting the target temperature setting menu such that a first target temperature of the wash water stored in the first tub is prevented from being set to a temperature equal to or higher than a first threshold temperature, according to the second target temperature; and determining the first threshold temperature based on a driving current of the second heater corresponding to the second target temperature and a predetermined reference current.

8. The method according to claim 7, wherein, when the second target temperature is equal to or higher than a predetermined second threshold temperature, the limiting the target temperature setting menu includes limiting the target temperature setting menu such that the first target temperature of the wash water stored in the first tub is prevented from being set to the temperature equal to or higher than the first threshold temperature.

* * * * *